United States Patent [19]

Bell et al.

[11] Patent Number: 4,635,889

[45] Date of Patent: Jan. 13, 1987

[54] DRAPERY SUPPORT SYSTEM WITH DECORATIVE ROD END SUPPORT STRUCTURE

[75] Inventors: David E. Bell, Sturgis; Dennis G. Babbs, Colon, both of Mich.

[73] Assignee: Cooper Industries, Houston, Tex.

[21] Appl. No.: 747,159

[22] Filed: Jun. 20, 1985

[51] Int. Cl.[4] ..... B61L 11/08

[52] U.S. Cl. ..... 248/265; 248/257; 211/105.2

[58] Field of Search ..... 248/265, 261, 262, 243, 248/257; 211/105.2, 105.1

[56] References Cited

U.S. PATENT DOCUMENTS

| | | | |
|---|---|---|---|
| 823,259 | 6/1906 | Burns | 211/105.2 X |
| 1,056,325 | 3/1913 | Dahlberg | 211/105.2 |
| 2,332,207 | 10/1943 | Derman | 248/262 X |
| 3,030,060 | 4/1962 | Breuer | 248/265 |
| 4,179,091 | 12/1979 | Bidney | 248/265 |
| 4,363,459 | 12/1982 | Holzer | 248/265 |

*Primary Examiner*—Robert W. Gibson, Jr.
*Assistant Examiner*—Blair M. Johnson
*Attorney, Agent, or Firm*—E. E. Scott; A. R. Thiele

[57] ABSTRACT

A drapery support rod assembly including opposed support brackets for supporting the rod at a predetermined distance with respect to a vertical wall and giving the appearance of a continuous rod section extending from the wall at each end. Opposed elongated channel shaped bracket members, inner cover members and outer cover members are preassembled by a threaded fastener and secured to the rod section by tang portions of the bracket members for securing the bracket assemblies to the rod section. The bracket assemblies may be loosely secured, one part to the others and secured to the rod section and then assembled to the wall brackets by a push-on operation. The wall brackets include generally horizontally projecting arm portions with elongated slots formed therein for receiving the assembly of the channel shaped bracket member and the inner cover part. The outer cover parts may include extension members having an outer wall shape corresponding to the outer wall shape of the outer cover members to selectively extend the position of the rod section with respect to a wall surface.

15 Claims, 5 Drawing Figures

DRAPERY SUPPORT SYSTEM WITH DECORATIVE ROD END SUPPORT STRUCTURE

BACKGROUND OF THE INVENTION

1. Field of the Invention

The present invention pertains to a drapery rod support system including opposed rod end support brackets having decorative support members which give the visual impression of a continuous rod member projecting from the wall surface.

BACKGROUND

Conventional drapery support systems are characterized by an elongated support rod which is typically formed from an extruded metal or plastic member which is configured to form a guideway for a plurality of slide members including a master slide and individual pleat support slides which may be interconnected by a traverse cord system. The support rod is typically mounted on spaced apart wall brackets to provide for support of the rod at a distance spaced from the wall surface around the window opening or other area for which the drapery is to form a closure.

Prior art type drapery rod support systems have typically been characterized by somewhat unsightly wall bracket structure thereby sometimes requiring the use of additional structure which must be mounted on the wall to form a shield or cover to enclose the wall brackets. Moreover, most types of rod support brackets do not provide for closing the ends of the rod extrusion to prevent unwanted exposure and loss of the pleat carrier or slide members from the open ends of the rod sections. Although separate plug members may be provided for the ends of the rod sections these items do not serve any other purpose and do not form a part of the support structure for the rod itself.

Another problem associated with prior art support bracket structure for drapery rods and the like pertains to the difficulty in assembling the rod and the support bracket to the mounted wall bracket part and suitably securing the brackets the base or wall bracket parts. Apart from the somewhat unattractive appearance of the wall bracket structure it is particularly difficult to assemble the rod and rod support structure to wall brackets and often requires one person to hold the rod in position while each bracket is assembled or connected to the wall bracket part. Accordingly, there has been need for several improvements in the art of drapery rod support systems, particularly of the type using a decorative extruded shell like support rod for the drapery panel traverse and support system. The abovementioned problems and disadvantages of prior art drapery rod support systems have been largely overcome by the present invention.

SUMMARY OF THE INVENTION

The present invention provides an improved drapery rod support structure particularly of the type for supporting an elongated shell-like or tubular type support rod wherein a decorative push-on type end structure is provided for opposite ends of the drapery rod which provides the appearance of a continuous rod section projecting from the wall and to provide ease of assembly and disassembly of the rod with respect to the wall support brackets.

In accordance with an important aspect of the present invention, a drapery rod support system is provided including opposed bracket assemblies comprising a formed metal or plastic bracket part, a bracket cover plate and a decorative corner member which may be preassembled and/or adapted to be pushed onto a bifurcated support bracket base part which may be premounted against a vertical wall or other suitable support.

In accordance with another important aspect of the present invention, a support bracket for a drapery rod is provided wherein a decorative rod part includes a projection which is insertable in the open end of a somewhat tubular or channel shaped rod member and has a configuration corresponding substantially to the cross sectional configuration or outline of the rod member to give the appearance of a continuation of the rod member as being bent at a right angle around the support bracket. Moreover, the corner bracket member is configured to support the end of the relatively thin cross section of the tubular rod member to provide additional support for the rod and to prevent collapse or bending thereof.

In accordance with still further aspects of the present invention there is provided a decorative drapery rod support structure which may be preassembled to the drapery rod and assembled to premounted wall brackets by merely pushing the rod brackets onto the premounted wall brackets and securing the rod assembly to the wall brackets by tightening one or more threaded fasteners which are used to hold the bracket structure in assembly prior to mounting. The support system of the present invention also provides for variable spacing of the rod with respect to the plane of the wall on which it is supported by the insertion of one or more spacer members forming continuations of the decorative corner or outside support members.

The abovementioned advantages as well as other superior features of the present invention will be further appreciated by those skilled in the art upon reading the detailed description in conjunction with the drawing.

DESCRIPTION OF A PREFERRED EMBODIMENT

Figure 1:
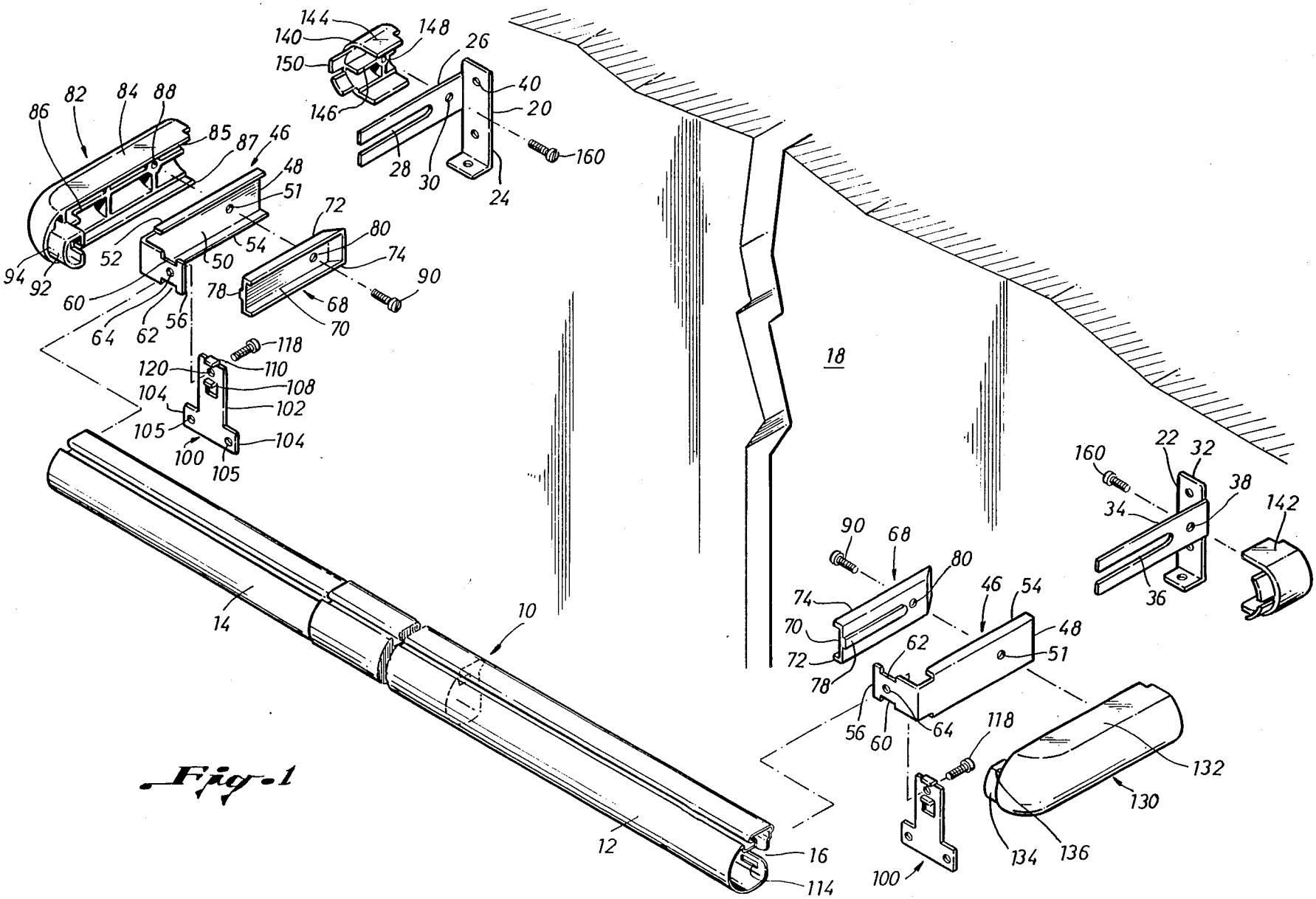
FIG. 1 is an exploded perspective view of an improved drapery rod and support bracket assembly in accordance with the present invention.

In the description which follows like parts are marked throughout the specification and drawing with the same reference numerals, respectively. The drawing figures are not necessarily to scale and certain features of the invention may be shown exaggerated in scale in the interest of clarity.

Referring to FIG. 1, there is illustrated in disassembled relationship substantially all of the parts comprising support means for an elongated drapery panel support rod assembly, generally designated by the numeral 10. The drapery support rod assembly is characterized by two telescoping rod sections 12 and 14 which are similar in cross sectional configuration although the rod section 14 is dimensioned to be telescopingly slidable within the rod section 12. The rod sections 12 and 14 are characterized as elongated relatively thinwalled tubular extrusions or otherwise formed members which are adapted to have an elongated slot 16 formed along one side thereof for supporting a plurality of drapery panel slide or carrier members, not shown. Conventional hardware for supporting a drapery panel, not shown, has been omitted from FIG. 1 in the interest of clarity since these components form no part of the present invention. In like manner the traverse cord system, if used in connection with a drapery support rod such as the rod assembly 10, has also been eliminated in the interest of clarity and conciseness. Those skilled in the art will recognize, however, that the rod support structure described herein may be used in conjunction with various drapery or curtain rod assemblies.

The rod assembly 10 is adapted to be supported at a predetermined distance spaced from a vertical wall 18, for example, by means including a pair of spaced apart base or wall bracket members 20 and 22. The wall bracket members 20 and 22 are of so called left hand and right hand configuration although in connection with the other components of the present invention the wall bracket members could be constructed to be identical wherein one member is inverted with respect to the other member when mounted on a vertical surface such as the wall 18. The wall bracket member 20 includes a base portion 24 and a laterally projecting bifurcated arm portion 26 including an elongated slot 28 formed therein. A fastener receiving hole 30 is also preferably formed between the closed end of the slot 28 and the base portion 24 for a purpose to be described further herein. In like manner, the bracket member 22 includes a base portion 32 and a bifurcated arm 34 projecting normal to the base portion and including an elongated slot 36 corresponding to the slot 28. A fastener receiving hole 38 is formed in the arm portion 34 between the closed end of the slot 36 and the base portion 32. The wall bracket members 20 and 22 are preferably formed of metal plate which may be bent and stamped to form the slots 28 and 36 and also to form the fastener receiving holes 30, 38 and further fastener receiving holes 40 formed in the respective base portions 24 and 32.

The rod assembly 10 is advantageously adapted to be assembled to and supported by the wall brackets 20 and 22 by opposed rod end or corner support bracket assemblies which include decorative elbow or corner members which may be configured to give the appearance that the rod sections 12 and 14 form continuous members which are bent and extend toward the wall 18. Each end of the rod assembly 10 is supported by a bracket assembly including a support bracket member 46 characterized by an elongated channel shaped portion 48 having a web 50 with a fastener clearance hole 51 formed therein and opposed flanges 52 and 54. An integrally formed tang portion 56 extends from the web 48 and projects normal thereto. The tang portion 56 includes opposed somewhat u-shaped recesses 60 and 62 and a fastener receiving hole 64 formed therein and between the recesses.

The support bracket assembly for the rod assembly 10 further includes an inner bracket cover part 68 preferably formed as an elongated and also somewhat channel shaped member having a web 70 and opposed flanges 72 and 74. The surface of the web 70 opposite the channel formed by the flanges 72 and 74 preferably includes an elongated projection or key 78 projecting from the web surface and extending to a point adjacent to a fastener receiving hole 80. The cover part 68 is dimensioned to be nested within the channel portion 48 formed by the bracket member 46 wherein the flanges 72 and 74 are fitted within the channel formed by and between the flanges 52 and 54.

Figure 3:
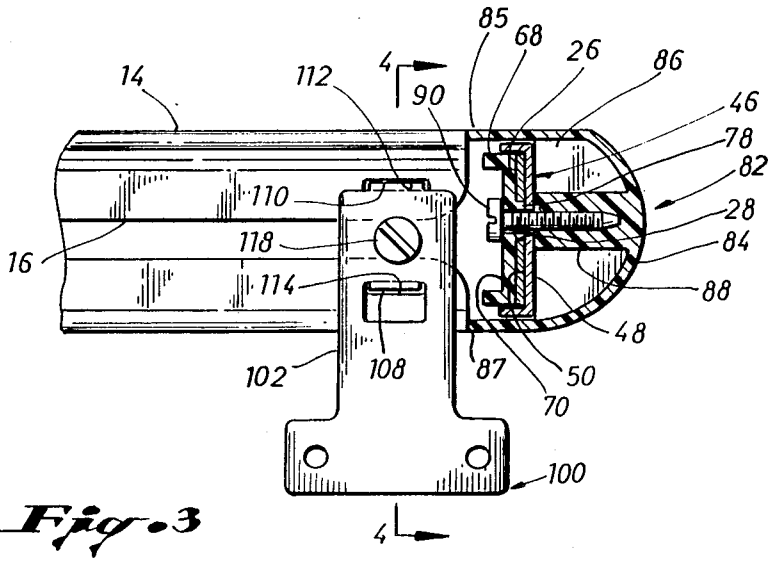
FIG. 3 is a detail section view taken along the line 3—3 of FIG. 2.

Each support bracket assembly for the drapery rod assembly 10 still further includes a decorative outer cover member, one of which is generally designated by the numeral 82. The outer cover member 82 is preferably formed of molded plastic or the like and has a contoured outer peripheral wall 84 and a supporting web structure, generally designated by the numeral 86, including at least one boss 88 formed with a tapped hole for receiving a threaded fastener 90. The cover member 82 further includes a spigot portion 92 which projects from a transverse surface 94 delimiting one end of the outer peripheral wall 84. The spigot portion 92 is configured to fit within the open end of the rod section 14 in generally supportive relationship thereto and snuggly enough so as to minimize distortion or collapse of the generally c-shaped rod section. As illustrated in FIGS. 1 and 3, in particular, the outer peripheral wall 84 of the cover part 82 extends to opposed distal edge portions 85 and 87 which form a channel for receiving the bracket part 46 and the cover part 68 generally nested completely within the confines of the outer peripheral wall 84. In this way, from substantially all angles which the rod assembly 10 and the associated bracket assemblies would normally be viewed when in the mounted position, the support bracket structure is substantially hidden from view and, when assembled with the rod assembly 10 the cover part 82 gives the appearance of being a continuous curved extension of the rod section 14 extending toward the wall 18.

The inventive drapery support rod and support bracket assembly described herein further includes a clamp part or so called pendant plate, generally designated by the numeral 100. The clamp part 100 includes an upstanding base section 102 and opposed wing portions 104 which include holes 105 for receiving drapery support hooks or similar devices for suspending a drapery panel from the rod assembly and securing the drapery panel stationary at its outer end. The clamp part 100 includes spaced apart parallel projecting tang portions 108 and 110 which are adapted to be fitted in the opposed grooves 60 and 62 and to project into slots 112 and 114, FIG. 4, formed in the rod section 14, for example. The clamp part 100 and the bracket part 46 are held in assembly with the rod section 14 by a threaded fastener 118 which is threaded into the tapped fastener receiving hole 64 in the tang 56 and extends through a fastener clearance hole 120 formed in the clamp part. The fastener 118 also extends into the slot 16 in the rod section, 14 as illustrated in FIG. 5.

One particular advantage of the drapery rod support bracket assembly of the present invention resides in the fact that the bracket part 46, the cover part 68 and the outer cover part 82 may be preassembled with the rod section 14 and secured thereto before mounting on the wall bracket 20. For example, the bracket part 46 is secured between the cover part 68 and the outer cover part 82 by the fastener 90; however, the fastener 90 may be left relatively loosely assembled sufficient to permit insertion of the arm 26 of the wall bracket 20 between the web 50 and the web 70 of the respective bracket and cover parts 46 and 68 and wherein the fastener 90 extends along the slot 28 until the bracket assembly is pushed onto the arm 26 as far as desired.

Figure 2:
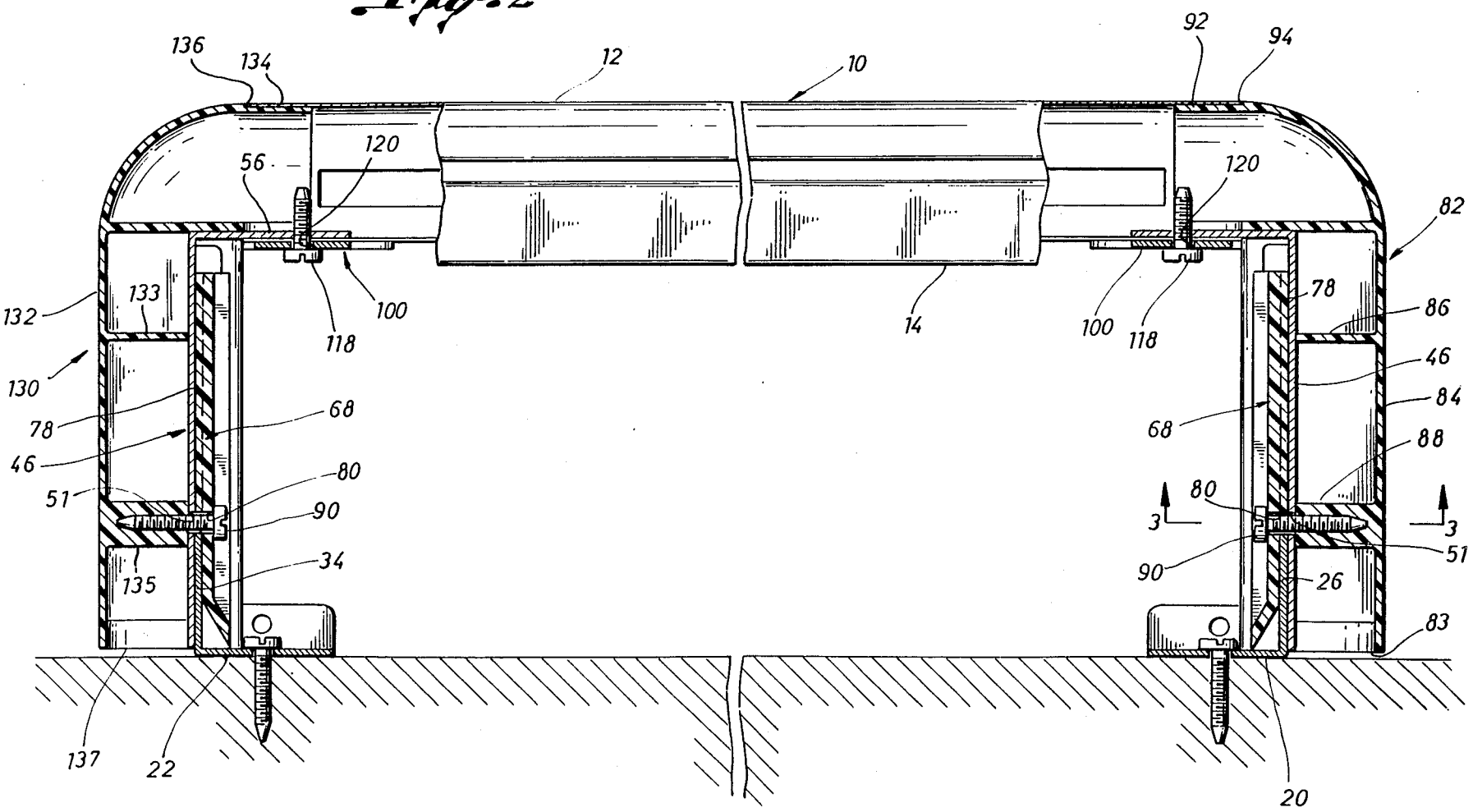
FIG. 2 is a plan view, in section, of the rod and support bracket assembly.
Figure 4:
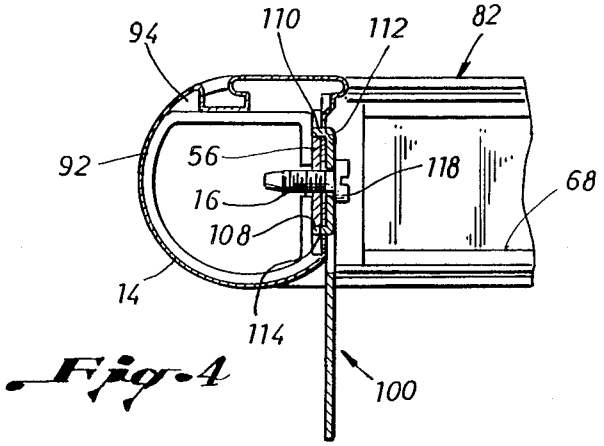
FIG. 4 is a detail section view taken from the line 4—4 of FIG. 3.
Figure 5:
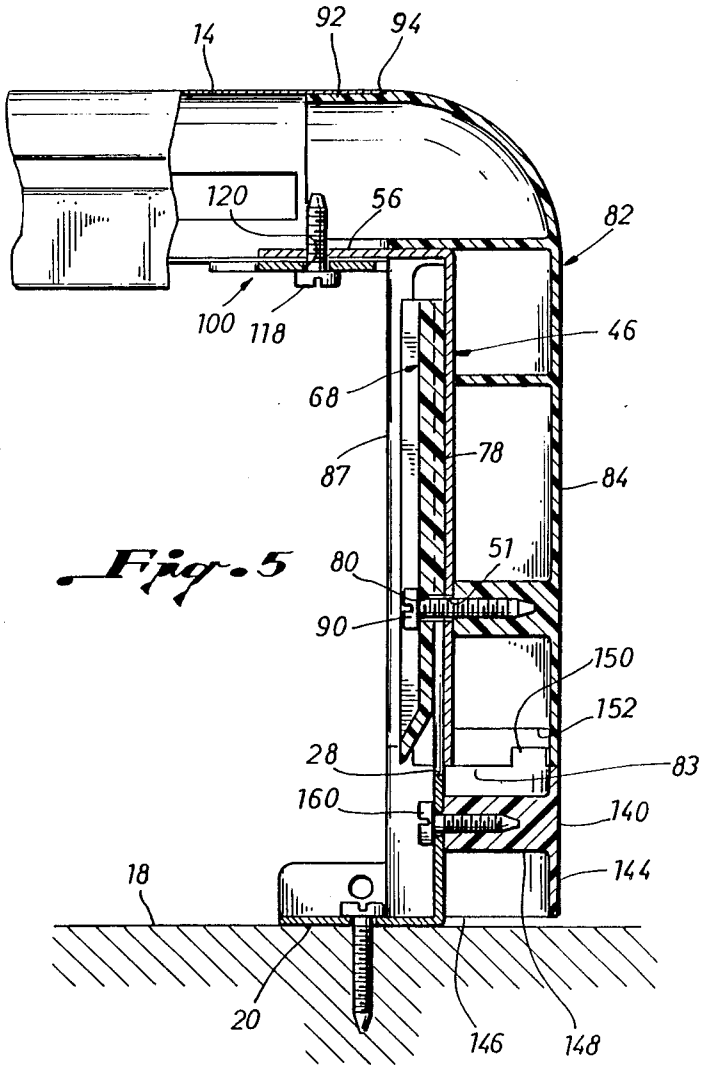
FIG. 5 a partial section view showing the installation of an extension section for extending the position of the rod away from a wall.

An assembled arrangement of the rod section 14 with the cover part 82, the bracket part 46 and the cover part 68 is illustrated in FIGS. 2, 3 and 4. As illustrated, the rod assembly together with the outer cover part 82 is supported on the wall bracket 20 in such a way that the cover part is spaced only slightly away from the surface of the wall as regards its distal end surface 83, FIG. 2. In this way the rod section 14 has the appearance of being a continuous member which has a portion extending normal to the wall 18. Once the bracket assembly is positioned on the wall bracket 20 as desired the fastener 90 is tightened to clamp the cover part 68 to the bracket part 46 and the outer cover part 82 between opposed surfaces of the arm 26.

The opposite end of the support rod assembly 10 is also provided with a bracket part 46, a cover part 68, a clamp part 100 and fasteners 90 and 118. An outer cover part 130 comprising a mirror image of the outer cover part 82 is also provided and is assembled to the bracket part 46 and the cover part 68 in virtually an identical manner as the parts 46, and 68 are assembled to the outside cover part 82. The outer cover part 130 also includes a contoured exterior wall portion 132 and a laterally projecting spigot 134 which projects from a wall surface 136 in the same manner that the spigot 92 projects from the wall surface 94. A supporting web 133 and fastener receiving boss 135 are molded integral with the wall 132. Due to the particular cross sectional shape of the drapery rod assembly 10 the cover parts 82 and 130 comprise "left" and "right" handed members. If the rod assembly were comprised of members having a cross sectional configuration symmetrical about a longitudinal central axis the outer cover parts 82 and 130 could be identical parts.

The outer cover part 130 is assembled to the bracket part 46 and the cover part 68 by a fastener 90 and the bracket part 46 secured to the outside cover part 130 is also secured to the rod section 12 by a clamp part 100 and a fastener 118 in the same manner as is illustrated by way of example for the outer cover part 82. For example, the outside cover part 132 includes the boss 135 similar to the boss 88 for the cover part 82 and which is adapted to receive a fastener 90 to assemble the outer cover part 130 initially rather loosely to the bracket part 46 and the cover part 68. The entire assembly of parts is mounted on the wall bracket 22 with the arm 34 extending into the channel formed between the flanges 52 and 54 of the channel portion 48 of the bracket part 46. With the fastener 90, which is holding the parts 46, 68 and 130 loosely in assembly, disposed in the slot 36 a position of the bracket assembly forming the "right hand" corner of the rod assembly 10 may be adjusted and the fastener 90 tightened to position the distal end 137, FIG. 2, of the outer cover part 130 closely adjacent the wall 18.

For applications of the drapery support rod assembly 10 wherein it is desired to space the rod assembly 10 farther from the wall 18 the outer cover parts 82 and 130 may be provided with extension spacer parts 140 and 142, FIG. 1, which comprise mirror images of each other. By way of example the part 140 has an outer contoured peripheral wall 144 and a web structure 146 including a fastener receiving boss 148, as shown in FIGS. 1 and 4. The extension part 140 also includes contoured or curvilinear shaped projections 150 which are adapted to extend into a recess 152 formed by the outer peripheral wall 84 of the cover part 82. The web structure 86 terminates short of the distal edge 83 of the outer cover part 82 to provide clearance for the projections 150.

The extension parts 140 and 142 may be secured to the respective wall bracket members 20 and 22 adjacent to the outer cover parts 82 and 130 by suitable threaded fasteners 160, respectively. Depending on the contour or cross sectional profile of the outer wall 144 required to conform to the shape and overall appearance of the outer cover part 82 and 130, for example, the parts 140 and 142 may also be identical if the configuration of the cover parts 82 and 130 is generally symmetrical about a longitudinal central axis or plane. The extension parts 140 and 142 may also be fabricated from cast metal or plastic. Moreover, the spacer or extension parts 140 and 142 may be supplied in various lengths within the limit of the lengths of the arms 26 and 34 of the respective wall brackets 20 and 22 whereby the position of the rod assembly 10 with respect to the wall 18 may be selectively varied.

It will be appreciated from the foregoing that a particularly unique drapery or similar type closure support rod assembly is provided by the present invention. Upon assembly of the bracket parts 46 and 68 to the respective outer cover parts 82 and 130 the tang portions 56 of the bracket parts may be inserted in the opposite ends of the support rod assembly 10 and secured by the respective clamp members 100 to the rod sections 12 and 14, respectively. The projections 92 and 134 provide support for the respective rod sections 14 and 12 to prevent loss of drapery slide carrier members or the like and to also minimize the risk of distortion of the cross sectional shape of the relatively thin walled extruded rod sections 12 and 14.

The assembly of each of the outer cover parts 82 and 130 together with the connected rod assembly 10 may simply be pushed onto the respective wall brackets 20 and 22 in such a way that the fasteners 90 extend into the slots 28 and 36, respectively and the key or tongue portions 78 of the cover parts 68 extend into the respective slots also. The wall brackets 20 and 22 firmly support the rod assembly over virtually the entire length of the channel portions of the bracket members 46 to distribute the loading thereon. When the support rod assembly has been mounted on the wall bracket 20 and 22 it may be pushed toward the wall 18 until the fasteners 90 engage the closed ends of the slots 28 and 36 whereupon these fasteners may then be tightened to securely clamp the support rod assembly to the wall brackets.

The assembled apparatus described herein gives an aesthetically pleasing appearance of a continuous rod which is curved and extends from and returns to the wall 18. Of course, if the position of the rod sections 12 and 14 with respect to the wall is to be increased, the extension or spacer members 140 and 142 are inserted or suported on the wall brackets prior to pushing the bracket assemblies onto the wall brackets as described above.

As previously mentioned the rod sections 12 and 14 may be formed of relatively thin walled extruded plastic or metal, the wall brackets 20 and 22 and the bracket parts 46 and 100 may be stamped out of relatively thin metal plate and folded by suitable metal forming operations. The cover parts 68, the outer cover parts 82 and 130 and the outer cover extension or spacer parts 140 and 142 are preferably formed of molded plastic or cast metal and are given a finished appearance corresponding to the finish on the rod sections 12 and 14 so that these parts have the overall appearance of a continuous piece of rod section.

Although a preferred embodiment of the invention has been described in detail herein those skilled in the art will recognize that various detailed substitutions and modifications may be made. For example, the clamp parts 100 may be modified to serve as end pieces for connection to and support of various types of drapery panels. As mentioned earlier the overall contour or cross sectional shape of the rod sections 12 and 14 and the corresponding outer cover parts 82 and 130 may take various specific forms. Suffice it to say that the concept of providing a push on support bracket assembly having the appearance of a continuous drapery support rod in accordance with the present invention may take various specific forms without departing from the scope and spirit of the invention as recited in the appended claims.

What we claim is:

1. A support rod assembly for drapery panels and the like comprising:

an elongated rod member having a predetermined decorative cross-sectional shape;

opposed wall brackets adapted to be mounted on a vertical wall surface or the like in a spaced apart relationship, each of said wall brackets including a substantially horizontally projecting cantilever arm portion;

a bracket member adapted to be supported on each of said wall brackets respectively, said bracket member further including a channel shaped portion having a web and opposed flanges dimensioned to receive said horizontally projecting cantilever portion in a nested relationship and means for securing said bracket member to said elongated rod member;

an inner cover part cooperable with said bracket member for mounting said bracket member on said arm portion of said wall bracket;

an outer cover part having a cross-sectional shape corresponding substantially to the cross-sectional shape of said elongated rod member and having the appearance of a continuation of said elongated rod member extending toward said wall when assembled with said elongated rod member and said bracket member on said wall bracket;

fastener means for securing said bracket member, said inner cover part and said outer cover part in assembly with each other and supported on said wall brackets; and means for securing said elongated rod member to said bracket member at each end of said elongated rod member for push-on assembly of said elongated rod member together with said bracket members onto and supported by said wall brackets.

2. The support rod assembly as defined in claim 1, wherein:

said bracket member further includes a tang portion projecting substantially normal to the longitudinal extend of said channel portion whereby said bracket member may be secured to said elongated rod member by said means for securing said bracket member to said elongated rod member at said tang portion.

3. The support rod assembly as defined in claim 2, wherein:

said tang portion is adapted to extend into the interior of said elongated rod member and said means for securing said bracket member to said elongated rod member includes a clamp member and fastener means for clamping said tang portion to said elongated rod member operatively associated therewith to prevent disconnecting said bracket member from said elongated rod member.

4. The support rod assembly as defined in claim 2, wherein:

said inner cover part includes an elongated key portion extending from a generally flat surface on said inner cover part and said wall bracket includes an elongated slot opening toward a distal end of said substantially horizontal projecting cantilever arm, said elongated slot opening adapted to receive said elongated key portion to align said bracket members and said elongated rod member with respect to said wall brackets.

5. The support rod assembly as defined in claim 1, wherein:

said outer cover part includes a spigot portion projecting from a surface of said outer cover part constructed and arranged to extend into an end of said elongated rod member in a close fitting and supportive relationship thereto.

6. The support rod assembly as defined in claim 1, wherein:

said outer cover part includes a peripheral outer wall portion including opposed co-extensive distal edge portions at least partially enclosing said bracket member in said inner cover part when in assembly with said bracket member and said inner cover part.

7. The support rod assembly as defined in claim 6, including:

an extension part for each of said outer cover parts including an outer peripheral wall corresponding in shapes substantially to the shape of the outer peripheral wall of said outer cover part; and means for supporting said extension part on said wall bracket to form an extension of said outer cover part in accordance with a preselected position of said elongated rod member with respect to said wall.

8. The support rod assembly as defined in claim 7, wherein:

said extension part includes a projection constructed and arranged to extend into a recess in said outer cover part for aligning said extension part with said outer cover part.

9. A support rod system for drapery panels and the like comprising:

an elongated rod member having a predetermined decorative cross-sectional shape;

opposed wall brackets adapted to be mounted on a vertical wall surface in a spaced apart relationship, each wall bracket including:

a generally horizontal projecting cantilever arm portion;

opposed bracket assemblies for supporting said elongated rod member on said wall brackets, each of said assemblies further including:

a bracket member adapted to be supported on each of said wall brackets respectively, said bracket member further including a channel shaped portion including a web and opposed flanges dimensioned to receive said horizontally projecting cantilever arm portion in a nested relationship and means for securing said bracket member to said elongated rod member;

an outer cover part having a cross-sectional shape corresponding substantially to the cross-sectional shape of said elongated rod member;

means for securing said cover part to said elongated rod member in such a way that said outer cover part has the appearance of a continuation of said elongated rod member extending toward said wall when assembled with said elongated rod member on said wall bracket; and fastener means for securing said bracket and said outer cover part in assembly and supported on said wall bracket.

10. The support rod system as defined in claim 9 wherein:

said outer cover part includes a spigot portion projecting from a surface of said outer cover part and configured to extend into an elongated rod member in close fitting and supportive relationship therewith.

11. The support rod system as defined in claim 10, wherein:

said outer cover part further includes a peripheral outer wall portion having exposed co-extensive distal edge portions at least partially enclosing said bracket member in assembly with said bracket member and said wall bracket.

12. The support rod system as defined in claim 9, including:

an extension for each of said outer cover parts including an outer peripheral wall corresponding in shapes substantially to the shape of an outer peripheral wall of said outer cover part and means for supporting said extension part on said wall bracket so as to form an extension of said outer cover part in accordance with a preselected position of said elongated rod member with respect to said wall.

13. The support rod system as defined in claim 12, wherein:

said extension part further includes a projection configured to extend into a recess in said outer cover part for aligning said extension part with said outer cover part.

14. A support rod arrangement for drapery panels and the like comprising:

an elongated rod member having a predetermined decorative cross-sectional shape, said elongated rod member further including opposed wall brackets adapted to be mounted on a wall surface in a spaced apart relationship, each wall bracket including a generally horizontal projecting cantilever arm portion and means for supporting said elongated rod member on said wall brackets:

said means for supporting said elongated rod member including:

a bracket member adapted to be supported on each of said wall brackets, respectively, and connected in supportive relationship to said elongated rod member;

said bracket member further including a channel shaped portion including a web and opposed flanges and means for securing said bracket member to said elongated rod member;

a cover part having a cross-sectional shape corresponding substantially to the cross-sectional shape of said elongated rod member; and means for supporting said cover part with respect to said elongated rod member in such a way that said cover part has the appearance of a continuation of said elongated rod member extending substantially normal to said elongated rod member and toward said wall when assembled with said elongated rod member on said wall bracket.

15. The arrangement in claim 14, wherein:

said means for supporting said cover part includes fasteners for securing said bracket member and said cover part in assembly and supported on said wall

* * * * *